US010144025B2

(12) United States Patent
Arvanitidoou et al.

(10) Patent No.: US 10,144,025 B2
(45) Date of Patent: Dec. 4, 2018

(54) DISPENSING CONTAINER

(71) Applicant: COLGATE-PALMOLIVE COMPANY, New York, NY (US)

(72) Inventors: Evangelia Arvanitidoou, Princeton, NJ (US); Rensl Dillon, Ewing, NJ (US); Kathleen Frisch, Belle Meade, NJ (US); Eduardo Jimenez, Manalapan, NJ (US); Joann Darcy-Siegel, Somerset, NJ (US); David K. Lee, East Brunswick, NJ (US); Kelly Gail Duncan, Washington, NJ (US); Matthew Lee Kolb, Upper Black Eddy, PA (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/102,722

(22) PCT Filed: Dec. 11, 2013

(86) PCT No.: PCT/US2013/074382
§ 371 (c)(1),
(2) Date: Jun. 8, 2016

(87) PCT Pub. No.: WO2015/088512
PCT Pub. Date: Jun. 18, 2015

(65) Prior Publication Data
US 2016/0310977 A1 Oct. 27, 2016

(51) Int. Cl.
*B05B 11/00* (2006.01)
*A47K 5/12* (2006.01)
*B05B 15/30* (2018.01)

(52) U.S. Cl.
CPC ..... *B05B 11/3081* (2013.01); *A47K 5/1211* (2013.01); *B05B 11/3001* (2013.01); *B05B 15/30* (2018.02)

(58) Field of Classification Search
CPC ..... B05B 11/3081; B05B 11/3001; B05B 15/005; A47K 5/1211
See application file for complete search history.

(56) References Cited

U.S. PATENT DOCUMENTS 2,932,433 A * 4/1960 Abplanalp ..... B65D 83/32 222/402.1
3,129,855 A * 4/1964 Malakoff ..... B65D 83/32 222/394

(Continued)

FOREIGN PATENT DOCUMENTS

GB 2353828 A 7/2001

OTHER PUBLICATIONS

International Search Report and the Written Opinion of the International Searching Authority issued in International Application PCTPCT/US2013/074382 dated Jun. 27, 2014.

*Primary Examiner* — Patrick M Buechner
*Assistant Examiner* — Michael J Melaragno

(57) ABSTRACT

A container comprising a body portion and a neck portion, the neck portion having a pump dispenser thereon, the pump dispenser comprising a pump mechanism, a dip tube on one end of the pump mechanism, a pump outlet on another end of the pump mechanism, the dip tube extending downwardly from the pump mechanism into the body portion, the body portion containing a first liquid, the dip tube having a central bore along which the first liquid is pumped from the body portion when the pump mechanism is actuated, and a reservoir containing a second liquid, the reservoir communicating with the dip tube and adapted to introduce the (Continued)

second liquid into the first liquid within the pump mechanism or dip tube under the action of first liquid flowing through the dip tube.

16 Claims, 4 Drawing Sheets

(56) References Cited

U.S. PATENT DOCUMENTS 3,685,696 A * 8/1972 Marraffino ..... B65D 83/20 222/136
3,690,515 A * 9/1972 Ewald ..... B65D 83/682 222/136
3,704,811 A * 12/1972 Harden, Jr. ..... B05B 7/2427 222/4
3,704,814 A * 12/1972 Ruscitti ..... B65D 83/682 222/136
3,710,984 A * 1/1973 Webster ..... B65D 83/66 222/136
3,786,963 A * 1/1974 Metzler, III ..... B05B 11/3081 222/136
3,982,668 A * 9/1976 Riccio ..... G01F 11/32 222/136
4,355,739 A * 10/1982 Vierkotter ..... B05B 11/3081 222/134
4,595,127 A * 6/1986 Stoody ..... B05B 7/2421 222/135
5,339,990 A 8/1994 Wilder
5,439,141 A * 8/1995 Clark ..... B05B 11/0056 222/136
5,544,810 A * 8/1996 Horvath, Jr. ..... B05B 7/2443 239/10
5,711,457 A * 1/1998 Wanbaugh ..... B05B 11/3011 222/136
5,819,987 A 10/1998 Miller
5,836,479 A * 11/1998 Klima ..... B05B 11/0056 222/130
5,871,122 A * 2/1999 Klima ..... B05B 11/0056 222/130
5,890,624 A * 4/1999 Klima ..... B05B 11/00 222/129
5,918,771 A * 7/1999 van der Heijden ... B05B 7/0025 222/136
5,944,223 A * 8/1999 Klima ..... B05B 11/0056 222/129
6,220,483 B1 * 4/2001 van der Heijden ..... B05B 11/3085 222/136
6,319,453 B1 * 11/2001 Klima, Jr. ..... B05B 11/0056 264/504
6,520,380 B1 2/2003 Veltrop et al.
6,843,390 B1 * 1/2005 Bristor ..... B05B 11/3081 222/145.5
7,565,988 B2 * 7/2009 Foster ..... B05B 11/0056 222/129
9,604,238 B2 * 3/2017 Geldard ..... B05B 15/005
2003/0000961 A1 * 1/2003 Klima ..... B05B 11/0056 222/83.5
2003/0201286 A1 * 10/2003 Ophardt ..... A47K 5/1202 222/481.5
2006/0213927 A1 9/2006 Behar et al.
2008/0314928 A1 12/2008 Banco et al.
2009/0277928 A1 11/2009 Bruckner
2010/0084430 A1 * 4/2010 Sim ..... B05B 11/0054 222/129
2010/0147887 A1 * 6/2010 Sim ..... B05B 11/0054 222/129
2010/0270334 A1 * 10/2010 Gioia ..... B05B 11/0037 222/377
2011/0108507 A1 * 5/2011 Sullivan ..... A45D 34/04 215/40
2011/0204090 A1 8/2011 Worthington et al.
2014/0061233 A1 * 3/2014 Lang ..... B05B 11/0018 222/1
2015/0352571 A1 * 12/2015 Petkus ..... B05B 7/2464 222/1
2017/0112331 A1 * 4/2017 Toh ..... A47K 5/14

* cited by examiner

DISPENSING CONTAINER

This invention is directed to a dispensing container and to a method of dispensing a liquid from a container. More particularly, this invention is directed to a dispensing container where the dip tube is provided with a decorative feature which also provides an additional function. The decorative feature may optionally coordinate with a design on the front or rear of the container.

BACKGROUND

Dispensing containers with dip tubes are used to store and dispense a range of personal care products. These include hand soaps, hand and body lotions, shampoos and body cleansing gels. There is a constant need to enhance the appearance of these containers. Various prior patent specifications disclose structures intended to enhance the appearance of the container, and some exhibit a dynamic, moving feature which is operable during dispensing. A recent example is the Applicant's WO-A1-2013/019207. Furthermore, such personal care products often include fragrance. The fragrance intensity or bloom can be detrimentally reduced as a result of the personal care products being stored in the dispensing container.

The present invention aims to improve the appearance of a container and its product during use.

The present invention also aims to provide a simple and reliable structure which can be dynamically operated by the user during product dispensing.

The present invention further aims to provide a dispensing container for a personal care product which can enhance the fragrance intensity or bloom when the product is dispensed.

BRIEF SUMMARY

The invention provides a container comprising a body portion and a neck portion, the neck portion having a pump dispenser thereon, the pump dispenser comprising a pump mechanism, a dip tube on one end of the pump mechanism, a pump outlet on another end of the pump mechanism, the dip tube extending downwardly from the pump mechanism into the body portion, the body portion containing a first liquid, the dip tube having a central bore along which the first liquid is pumped from the body portion when the pump mechanism is actuated, and a reservoir containing a second liquid, the reservoir communicating with the dip tube and adapted to introduce the second liquid into the first liquid within the pump mechanism or dip tube under the action of first liquid flowing through the dip tube.

The invention further provides a method of dispensing of a liquid from a container, the method comprising the steps of:

a. providing a dispensing container including a pump mechanism and a dip tube extending downwardly from the pump mechanism into a first liquid to be dispensed from the container;
b. operating the pump mechanism to cause the first liquid to flow upwardly through the dip tube and out of an upper end of the pump mechanism; and
c. introducing a second liquid into the first liquid within the pump mechanism or dip tube under the action of first liquid flowing through the dip tube, the second liquid being contained in a reservoir communicating with the dip tube.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
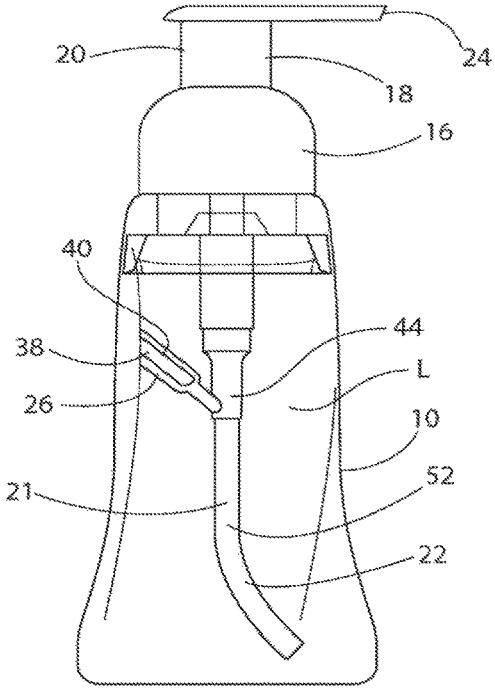
FIG. 1 is an elevation view of a dispensing container having a dip tube with an integral dropper in accordance with a first embodiment of the invention.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

The invention will be disclosed in its preferred embodiments with reference to the Figures in the drawings. The dispensing container has an enhanced appearance before and during use by a consumer to dispense the product contained within the container.

Figure 2:
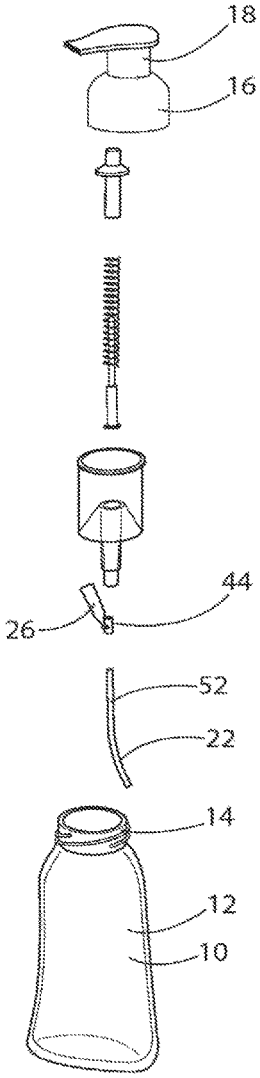
FIG. 2 is an exploded elevation view of the dispensing mechanism of the dispensing container of FIG. 1.
Figure 3:
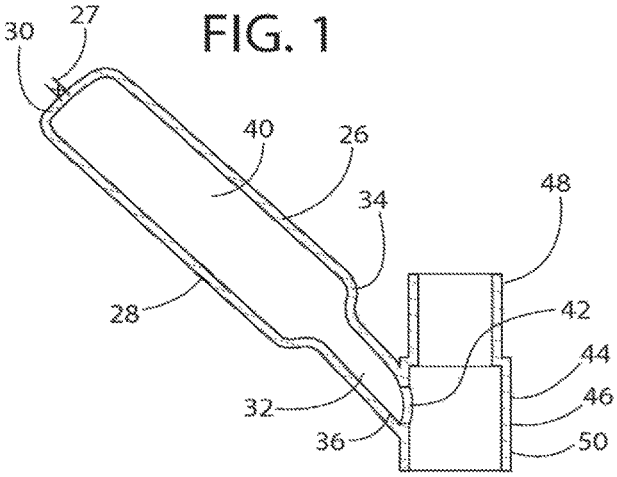
FIG. 3 is an enlarged elevation view of the dropper in the dispensing mechanism of the dispensing container of FIG. 1.

FIGS. 1, 2 and 3 show a dispensing container 10 with the enhanced appearance. The dispensing container is comprised of a body portion 12 and a neck portion 14. The neck portion 14 has closure 16. Mounted in the closure is a pump mechanism 18 with a dip tube 22 at one end and an actuator 20 with a dispensing channel exiting at a pump outlet 24. The dip tube 22 extends downwardly from the pump mechanism 18 into the body portion 12 which contains a liquid L to be dispensed. The liquid may be, for example, selected from hand soaps, hand and body lotions, shampoos and body cleansing gels. When the pump mechanism 18 is activated by manual depression of the dispensing activator 20, liquid in body portion 12 travels up a central bore 21 of the dip tube 22, through the pump mechanism 18 and then through outlet 24. The pump mechanism 18 is a conventional self-priming pump mechanism well known in the art.

A dropper 26 is fitted to or integral with the dip tube 22 so as to be coupled to the dip tube 22. The dropper 26 comprises a transparent vial 28 sealed at one end 30 and provided with a one-way pressure relief valve 27 to permit flow of liquid L into the end 20 of the dropper 26 to displace liquid within the dropper 26 as that liquid is dispensed from the dropper 26. A capillary tube 32 extends from the other end 34 of the vial 28 and the lower end 36 of the capillary tube 32 remote from the vial 28 connects with the dip tube 22 via an orifice 42. The capillary tube 32 is transparent. The dropper 26 is downwardly oriented towards the lower end 36. A fragrance oil 38 is disposed within the vial 28 which acts as a reservoir 40 for the fragrance oil 38. The fragrance oil 38 is colored with a dye or pigment so that the fragrance oil 38 is visible from the exterior of the dispensing container 10. At least a part of the body portion 12 is transparent and the liquid L is typically transparent or translucent. In the embodiment of FIG. 1, at least a portion of the dip tube 22 adjacent to the orifice 42 is transparent and is visible from an exterior of the container.

In the illustrated embodiment, the dropper 26 is integral with an upper end part 44 of the dip tube 22. The upper end part 44 of the dip tube 22 comprises a tubular portion 46 which is fitted, by bonding or a compression fitting, at its upper portion 48 to the pump mechanism 18 and at its lower portion 50 to an elongate tubular lower end part 52 of the dip tube 22. The upper end part 44 of the dip tube 22 may be a molded section, such as being formed by injection or blow molding. The lower end part 52 of the dip tube 22 is typically flexible and may be formed by extrusion to an elongated form.

The lower portion 50 may optionally be fitted with a one way valve (not shown) to prevent or inhibit siphoning of liquid fragrance oil 38 from reservoir 40 through the orifice 42 and down into the dip tube 22.

A decorative element, not shown, may be fitted to or integral with the vial 28. The decorative element may have a visual association with the fragrance, for example illustrating a flower when the fragrance is a floral fragrance.

When the pump mechanism 18 is activated by manual depression of the dispensing activator 20, this imparts upward liquid flow through the dip tube 22 during the dispensing operation. As the liquid flows past the lower end 36 of the capillary tube 32, drops of fragrance oil are successively introduced into the liquid flow from the orifice 42 at the lower end 36 of the capillary tube 32. Depending on the liquid properties and the dispensing mechanism, the liquid flow may generate shear forces to pull a drop out of the capillary tube 32 and/or a reduced pressure in the liquid flow may suck a drop out of the capillary tube 32. The fragrance oil is gravity fed from the reservoir 40 to the lower end 36 of the capillary tube 32. This provides a constant supply of fragrance oil at the orifice 42.

The orifice 42 typically has a cross-sectional area so as not to exceed the surface tension of the fragrance oil in the liquid L so that drops of fragrance oil only enter the liquid L as a result of liquid flow past the orifice 42.

Since the fragrance oil is introduced dropwise into the liquid flow, this effect may be seen by a user. Also, over a period of time, as a result of plural successive dispensing operations, the volume of oil in the reservoir 40 is diminished. The diminishing volume of fragrance oil may also be visible to a user. Accordingly, the dropper and the visible fragrance oil therein provide a decorative effect visible from an exterior of the container 10.

Furthermore, the fragrance oil is stored in the reservoir 40 rather than in the liquid to be dispensed. Such separate storage of the fragrance oil in the reservoir 40 provides that the fragrance oil is exposed to a minimum amount or concentration of oxygen or air prior to dispensing. In turn, this provides that the fragrance intensity or bloom is maximized during product dispensing, because the fragrance oil is introduced into the liquid immediately prior to dispensing. Prior to dispensing, the fragrance oil is retained in the reservoir 40, and the vial 28 seals the fragrance oil against contact with the liquid or air apart from at the narrow bore orifice 42 of the capillary tube 32.

The pump mechanism 18 may include a screen or air chamber, or other pump parts, as are known in the art, such as a foamer mechanism, which would function to shear the fragrance and mix together the fragrance oil 38 and the liquid L during dispensing to provide a uniform mixture exiting outlet 24.

In an alternative embodiment, not illustrated, the dropper 26 can be vertically oriented so that the orifice 42 is upwardly directed. When the liquid L is pumped, a reduced pressure above the orifice 42 would tend to pump fragrance oil 38 up the capillary tube 32 and into the flow of liquid L. This modification has the advantage that fragrance oil 38 is less likely to be released inadvertently into liquid L as a result of shaking the container 10 because the fragrance oil 38 is held by gravity as well as surface tension in the reservoir 40.

Figure 4:
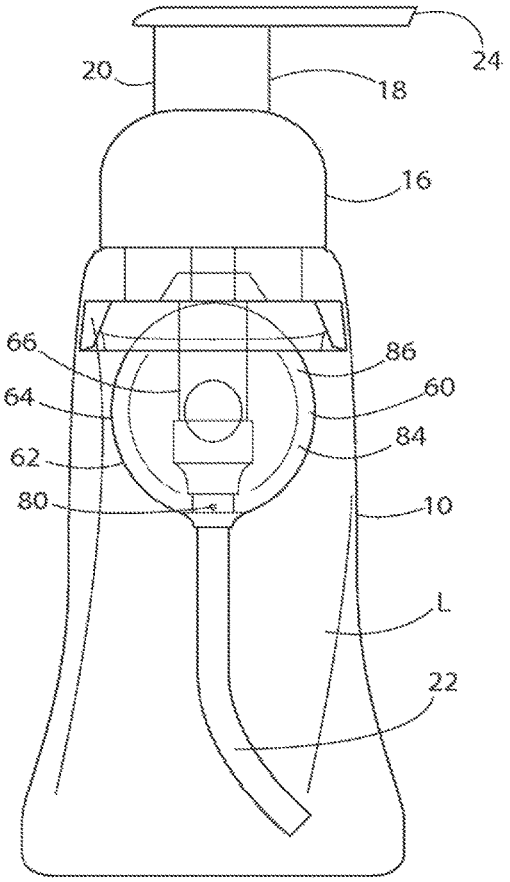
FIG. 4 is an elevation view of a dispensing container having a dip tube with an integral basin in accordance with a second embodiment of the invention.
Figure 5:
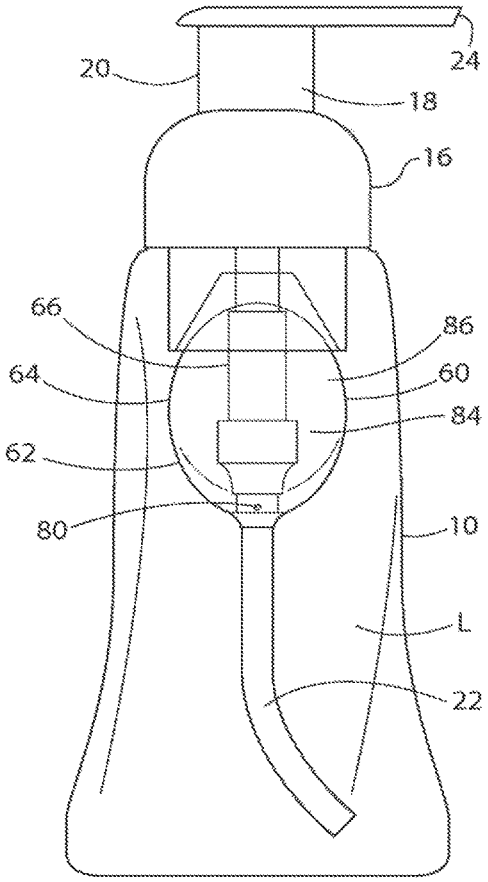
FIG. 5 is an elevation view of the dispensing container of FIG. 4 after dispensing of an amount of liquid from the basin and shrinkage of the basin.
Figure 6:
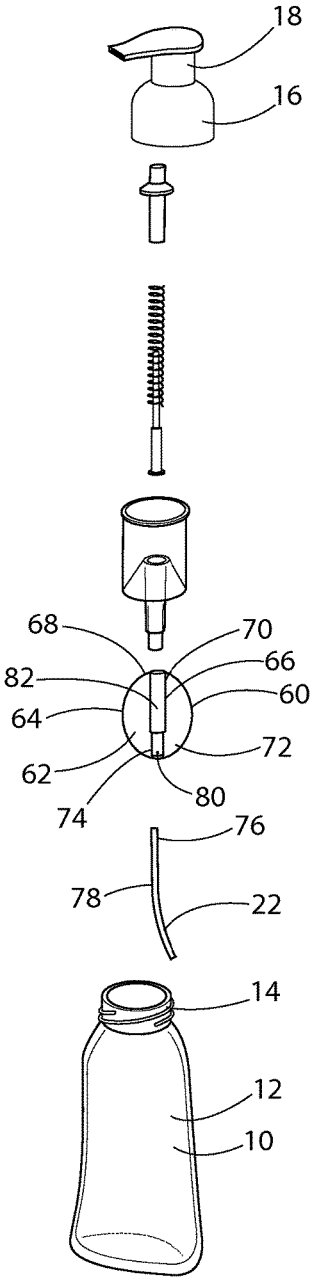
FIG. 6 is an exploded elevation view of the dispensing mechanism of the dispensing container of FIG. 4.

A second embodiment of a dispensing container is shown in FIGS. 4, 5 and 6.

In this embodiment, the dispensing container 10 is similar to that of the first embodiment. The dispensing container is comprised of a body portion 12 and a neck portion 14. The neck portion 14 has closure 16. Mounted in the closure is a pump mechanism 18 with a dip tube 22 at one end and an actuator 20 with a dispensing channel exiting at a pump outlet 24. The dip tube 22 extends downwardly from the pump mechanism 18 into the body portion 12 which contains a liquid L to be dispensed. The liquid may be, for example, selected from hand soaps, hand and body lotions, shampoos and body cleansing gels. When the pump mechanism 18 is activated by manual depression of the dispensing activator 20, liquid in body portion 12 travels up a central bore 21 of dip tube 22, through the pump mechanism 18 and then through outlet 24. The pump mechanism 18 is a conventional self-priming pump mechanism well known in the art.

In this embodiment, a flexible bulb 60 is fitted to the dip tube 22. The flexible bulb 60 defines a basin 62 between the outer bulb wall 64, which is flexible, and a central tubular element 66. The outer bulb wall 64 comprises a transparent film, typically composed of a polymer. An upper edge 68 of the outer bulb wall 64 is fitted, by bonding or a compression fitting, to an upper end 70 of the central tubular element 66 and a lower edge 72 of the outer bulb wall 64 is fitted, by bonding or a compression fitting, to a lower end 74 of the central tubular element 66. The upper end 70 is fitted, by bonding or a compression fitting, to the pump mechanism 18 and the lower end 74 is fitted, by bonding or a compression fitting, to the upper end 76 of an elongate tubular lower end part 78 of the dip tube 22. The central tubular element 66 may be a molded section, such as being formed by injection or blow molding. The lower end part 78 of the dip tube 22 is typically flexible and may be formed by extrusion to an elongated form.

At least one capillary orifice 80 is provided in the lower end 74 of the central tubular element 66, which communicates the basin 62 to the central tube 82 of the central tubular element 66 and thereby connects the basin 62 with the dip tube 22. The orifice(s) 80 again may be dimensioned so as each to have a cross-sectional area so as to provide drops of fragrance oil into the liquid L only as a result of liquid flow past the orifice(s) 80.

A fragrance oil 84 is disposed within the basin 62 which acts as a reservoir 86 for the fragrance oil 84. As for the first embodiment, the fragrance oil 84 is colored with a dye or pigment so that the fragrance oil 84 in the basin 62 is visible from the exterior of the dispensing container 10. At least a part of the body portion 12 is transparent and the liquid L is typically transparent or translucent.

A decorative element, not shown, may be fitted to or integral with the flexible bulb 60. The decorative element may have a visual association with the fragrance, for example illustrating a flower when the fragrance is a floral fragrance.

When the pump mechanism 18 is activated by manual depression of the dispensing activator 20, this imparts upward liquid flow through the dip tube 22 during the dispensing operation. As the liquid flows past the capillary orifice(s) 80, drops of fragrance oil are successively introduced into the liquid flow from the orifice(s) 80 at the lower end of the basin 62 containing the fragrance oil 84. Depending on the liquid properties and the dispensing mechanism, the liquid flow may generate shear forces to pull a drop out of the capillary orifice(s) 80 and/or a reduced pressure in the liquid flow may suck a drop out of the capillary orifice(s) 80. The fragrance oil is gravity fed from the reservoir 86 to the capillary orifice(s) 80. This provides a constant supply of fragrance oil at the orifice(s) 80.

Since the fragrance oil is introduced dropwise into the liquid flow, this effect may be seen by a user if at least the lower part of the central tubular element 66 is transparent. Also, over a period of time, as a result of plural successive dispensing operations, the volume of oil in the reservoir 86 is diminished. FIG. 4 shows the flexible bulb 60 initially full of fragrance oil and FIG. 5 shows the flexible bulb 60 after some amount of fragrance oil has been dispensed, and the corresponding reduction in the volume of the flexible bulb 60 can readily be seen.

The diminishing volume of fragrance oil may also be visible to a user. Since the bulb 60 is flexible, the bulb volume also is diminished as a result of plural successive dispensing operations, which is visible to a user. Accordingly, the flexible bulb 60 and the visible fragrance oil therein provide a decorative effect visible from an exterior of the container 10.

Furthermore, as for the first embodiment, the fragrance oil is stored in the reservoir 86 rather than in the liquid to be dispensed and the fragrance oil is introduced into the liquid immediately prior to dispensing. Prior to dispensing, the fragrance oil is retained in the reservoir 86, and the flexible bulb 60 seals the fragrance oil against contact with the liquid or air apart from at the capillary orifice(s) 80.

Figure 7:
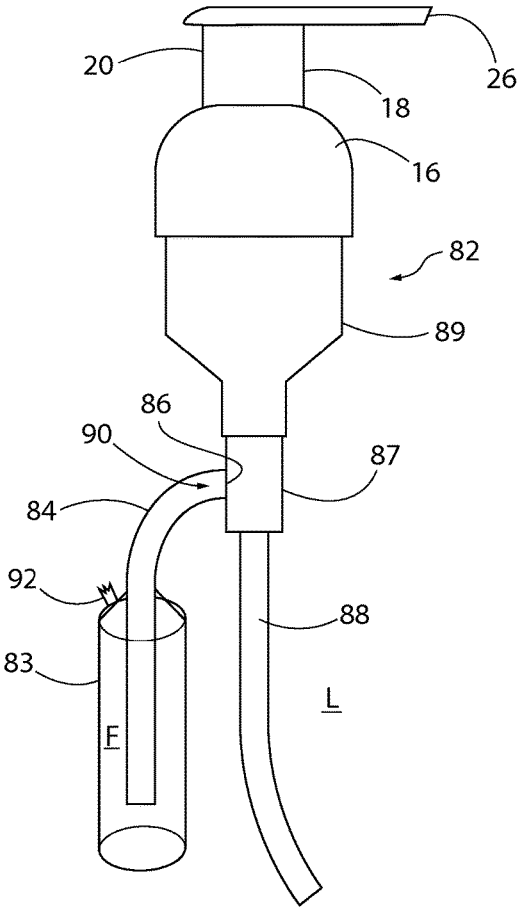
FIG. 7 is an enlarged elevation view of a dispensing mechanism for a dispensing container in accordance with a third embodiment of the invention, which is a modification of the embodiment of FIGS. 1 to 3.

A further dispensing mechanism is shown in FIG. 7, in accordance with a third embodiment of the invention, which is a modification of the embodiment of FIGS. 1 to 3. The dispensing mechanism 82 is disposed in a dispensing container (not shown) which is the same container as in the other embodiments. The dispensing mechanism 82 comprises a vial 83 containing a liquid, such as a fragrance oil F, to be introduced dropwise into the liquid L in the body of the container, as discussed hereinbefore. The vial 83 is upwardly oriented and a straw-like tube 84 extends downwardly into the vial 83 through a sealed upper surface 85 of the vial 83. The straw-like tube 84 connects to a side port 86 of a three-way connector 87 at the top of the dip tube 88 and beneath the pump 89. A one way valve 90 may be provided in the straw-like tube 84 to prevent liquid in the dip tube 88 from flowing back into the vial 83. The vial 83 may have flexible walls and be compressible, in a manner similar to the basin of the previous embodiment, and/or a one way valve 92 may be provided in the vial 83 to permit pressure equalization between the interior of the vial 83 and the container body.

In this embodiment, instead of gravity feeding the fragrance oil into the dip tube through capillary orifice(s), a straw-like tube 84 is provided which communicates between the vial 83 and the dip tube 88. Liquid flow through the dip tube 88 sucks liquid from the vial up the straw-like tube 84 and into the three-way connector 87 where the liquids are blended together.

In a further embodiment, the basin of FIGS. 4 to 6 incorporates an upwardly oriented straw-like tube therein, similar to the straw-like tube of FIG. 7, rather than capillary orifices, for controllably delivering the liquid in the basin dropwise into the dip tube or the pump mechanism as a result of liquid flow through the dip tube.

Figure 8:
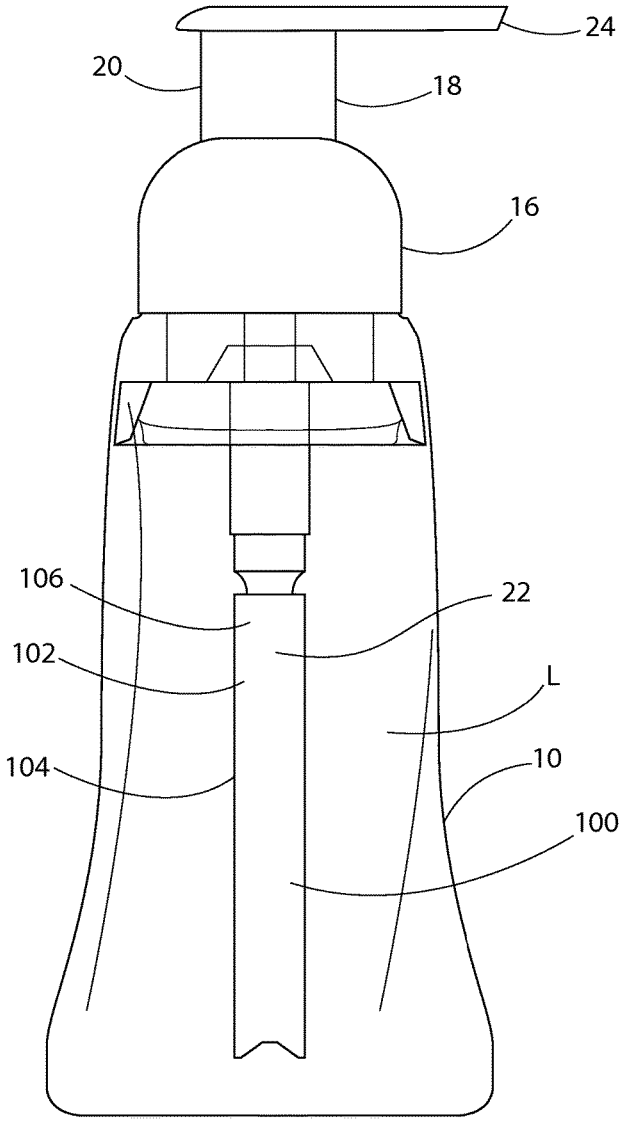
FIG. 8 is an elevation view of a dispensing container having a dip tube with an integral wicking mechanism in accordance with a fourth embodiment of the invention.
Figure 9:
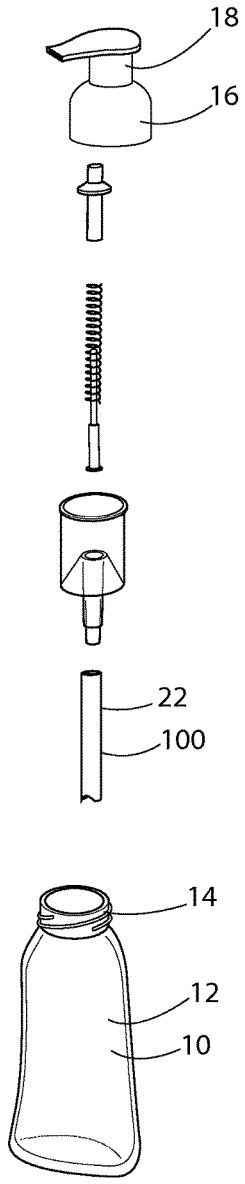
FIG. 9 is an exploded elevation view of the dispensing mechanism of the dispensing container of FIG. 8.

Referring to FIGS. 8 and 9, in a further embodiment the dispensing container 10 is similar to that of the previous embodiments. The dispensing container is comprised of a body portion 12 and a neck portion 14. The neck portion 14 has closure 16. Mounted in the closure is a pump mechanism 18 with a dip tube 22 at one end and an actuator 20 with a dispensing channel exiting at a pump outlet 24. The dip tube 22 extends downwardly from the pump mechanism 18 into the body portion 12 which contains a liquid L to be dispensed. The liquid may be, for example, selected from hand soaps, hand and body lotions, shampoos and body cleansing gels. When the pump mechanism 18 is activated by manual depression of the dispensing activator 20, liquid in body portion 12 travels up a central bore 21 of dip tube 22, through the pump mechanism 18 and then through outlet 24. The pump mechanism 18 is a conventional self-priming pump mechanism well known in the art.

In this embodiment, the dip tube 22 incorporates a wick element 100 which is pre-loaded with a fragrance oil 102. The wick element 100 typically comprises a tube of transparent or translucent porous material, such as a porous polymeric open-cellular foam, which contains fragrance oil 102 infused therein. The wick element 100 is surrounded by an impermeable layer 104, for example a transparent polymeric film, which prevents the fragrance oil 102 from leaching out of the dip tube 22 into the body portion 12 which contains the liquid L to be dispensed. The impermeable layer 104 may be provided with a one way valve at the bottom thereof, in order to equilibrate the pressure in the wick element 100 and liquid L, to prevent fragrance oil from leaching into the liquid L. The wick element 100 typically has a thickness dependent upon the desired liquid storage capacity of the wick element 100.

The wick element 100 acts as a reservoir 106 for the fragrance oil 102. As for the previous embodiments, the fragrance oil 102 is colored with a dye or pigment so that the fragrance oil 102 in the wick element 100 is visible from the exterior of the dispensing container 10. At least a part of the body portion 12 is transparent and the liquid L is typically transparent or translucent.

A decorative element, not shown, may be fitted to or integral with the wick element 100. The decorative element may have a visual association with the fragrance, for example illustrating a flower when the fragrance is a floral fragrance.

When the pump mechanism 18 is activated by manual depression of the dispensing activator 20, this imparts upward liquid flow through the dip tube 22 during the dispensing operation. As the liquid flows through the wick element 100, fragrance oil 102 is introduced into the liquid flow from the pores of the wick element 100 containing the fragrance oil 102.

The wick element 100 may have a hollow core in order to allow the liquid L to pass freely up the center of the wick element 100 and control fragrance dispensing into the liquid L.

Over a period of time, as a result of plural successive dispensing operations, the volume of fragrance oil in the wick element 100 is diminished. The diminishing volume of fragrance oil may also be visible to a user, as a result of reduced intensity of the color of the reduced concentration of the fragrance oil in the wick element 100. Accordingly, the wick element 100 and the visible fragrance oil therein provide a decorative effect visible from an exterior of the container 10.

Furthermore, as for the previous embodiments, the fragrance oil is stored in the reservoir 106 rather than in the liquid to be dispensed and the fragrance oil is introduced into the liquid immediately prior to dispensing. Prior to dispensing, the fragrance oil is retained in the reservoir 106, and the impermeable layer 104 seals the fragrance oil against contact with the liquid or air apart from in the interior tubular bore 106 of the wick element 100.

The container may be made of essentially any substantially transparent plastic. Glass may also be used. Useful plastics are polyvinyl chloride and polyethylene terephthalate. The dip tube and the associated parts may be produced from any plastic that can be extruded, and optionally blow-molded, or injection molded. Such polymers include homopolymers and copolymers of ethylene and propylene, vinyl compound homopolymers and copolymers, such as polyvinyl chloride, and polyesters such as polyethylene terephthalate.

The container may be provided with a label. The label can be shaped or partially transparent to reveal at least the reservoir, for example providing a window through which the reservoir may be viewed. The label may be applied by in-mold labeling or the use of a shrink film.

Front and/or rear labels may be composed of any substantially clear plastic. The preferred plastics are thermoplastics, such as polyethylene, polypropylene including biaxially oriented polypropylene, polyvinyl chloride and polyethylene terephthalate. The front and rear labels are typically printed. In-mold labels and shrink film labels may be composed of a wide range of monolayer and laminate materials, such as thermoplastic polymers.

Other modifications to the illustrated embodiments will be apparent to those skilled in the art and are within the scope of the present invention as defined in the appended claims.

What is claimed is:

1. A container comprising a body portion and a neck portion, the neck portion having a pump dispenser thereon, the pump dispenser comprising a pump mechanism, a dip tube on one end of the pump mechanism, a pump outlet on another end of the pump mechanism, the dip tube extending downwardly from the pump mechanism into the body portion, the body portion containing a first liquid, the dip tube having a central bore along which the first liquid is pumped from the body portion when the pump mechanism is actuated, and a reservoir containing a second liquid, the reservoir communicating with the dip tube and adapted to introduce the second liquid into the first liquid within the pump mechanism or dip tube under the action of first liquid flowing through the dip tube;

wherein the reservoir is provided in a dropper coupled directly to the dip tube, wherein the dropper comprises a vial sealed at one end and a capillary tube extending from the other end of the vial, an end of the capillary tube remote from the vial connecting with the dip tube via an orifice, the dropper being downwardly oriented such that the first liquid is gravity fed from the reservoir to the dip tube.

2. The container according to claim 1, wherein the second liquid comprises a fragrance oil, and wherein the first liquid is selected from liquid hand soaps, hand and body lotions, shampoos and body cleansing gels.

3. The container according to claim 1, wherein the second liquid in the reservoir is visible from an exterior of the container.

4. The container according to claim 1, wherein at least one of the vial and the capillary tube is transparent.

5. The container according to claim 4 wherein at least a portion of the dip tube adjacent to the orifice is transparent and is visible from an exterior of the container.

6. The container according to claim 1 wherein the dropper is downwardly oriented towards the orifice or is upwardly oriented with the orifice adjacent to a liquid flow path through the pump mechanism or dip tube.

7. The container according to claim 1, wherein the dip tube comprises an upper end portion and a lower end portion, wherein the dropper is integral with the upper end portion of the dip tube.

8. The container according to claim 7, wherein the upper end portion of the dip tube comprises a tubular portion which is fitted at an upper portion to the pump mechanism and at a lower portion to an elongate tubular lower end part of the dip tube.

9. A container comprising a body portion and a neck portion, the neck portion having a pump dispenser thereon, the pump dispenser comprising a pump mechanism, a dip tube on one end of the pump mechanism, a pump outlet on another end of the pump mechanism, the dip tube extending downwardly from the pump mechanism into the body portion, the body portion containing a first liquid, the dip tube having a central bore along which the first liquid is pumped from the body portion when the pump mechanism is actuated, and a reservoir containing a second liquid, the reservoir communicating with the dip tube and adapted to introduce the second liquid into the first liquid within the pump mechanism or dip tube under the action of first liquid flowing through the dip tube, wherein the reservoir is provided in a flexible bulb fitted to the dip tube, and wherein the flexible bulb defines a basin between a flexible outer bulb wall and a central tubular element which is fitted to the dip tube.

10. The container according to claim 9, wherein an upper edge of the outer bulb wall is fitted to an upper end of the central tubular element and a lower edge of the outer bulb wall is fitted to a lower end of the central tubular element.

11. The container according to claim 10, wherein the upper end of the central tubular element is fitted to the pump mechanism and the lower end of the central tubular element is fitted to an upper end of an elongate tubular lower end part of the dip tube.

12. The container according to claim 9, wherein at least one capillary orifice communicates the reservoir with the dip tube, and wherein the at least one capillary orifice is provided in a lower end of the central tubular element which communicates the basin to the central tube of the central tubular element and thereby connects the basin with the dip tube.

13. The container according to claim 1, wherein the reservoir is a vial and further comprising a straw with a one-way valve which communicates between the reservoir and the dip tube.

14. The container according to claim 13, wherein the straw extends downwardly into the reservoir and has an upper end adjacent to a liquid flow path through the pump mechanism or dip tube.

15. A method of dispensing of a liquid from a container, the method comprising the steps of:

a. providing a dispensing container including a pump mechanism and a dip tube extending downwardly from the pump mechanism into a first liquid to be dispensed from the container, wherein a reservoir is provided in a dropper coupled directly to the dip tube, wherein the dropper comprises a vial sealed at one end and a capillary tube extending from the other end of the vial, an end of the capillary tube remote from the vial connecting with the dip tube via an orifice, the dropper being downwardly oriented such that the first liquid is gravity fed from the reservoir to the dip tube;

b. operating the pump mechanism to cause the first liquid to flow upwardly through the dip tube and out of an upper end of the pump mechanism; and c. introducing a second liquid into the first liquid within the pump mechanism or dip tube under the action of first liquid flowing through the dip tube, the second liquid being contained in the reservoir communicating with the dip tube.

16. The method according to claim 15, wherein the second liquid comprises a fragrance oil and wherein the first liquid is selected from liquid hand soaps, hand and body lotions, shampoos and body cleansing gels.

* * * * *